US005495627A

United States Patent [19]

Leaverton et al.

[11] Patent Number: 5,495,627

[45] Date of Patent: Mar. 5, 1996

[54] COMBINATION ADJUSTABLE JET VALVE

[76] Inventors: Gregg Leaverton, 3412 Meadowview Dr.; Steve Rork, 846 Rivertree Dr., both of Oceanside, Calif. 92054

[21] Appl. No.: 147,171

[22] Filed: Nov. 2, 1993

[51] Int. Cl.[6] ..... A61H 33/00

[52] U.S. Cl. ..... 4/541.6; 239/413; 239/428.5

[58] Field of Search ..... 4/541.1–541.6; 239/413, 428.5, 541.1–541.6

[56] References Cited

U.S. PATENT DOCUMENTS

| | | | |
|---|---|---|---|
| 3,471,091 | 10/1969 | Baker | 4/541.6 X |
| 4,416,030 | 11/1983 | Reynoso | 4/541.6 |
| 4,800,046 | 1/1989 | Malek et al. | 4/541.6 X |
| 4,982,459 | 1/1991 | Henkin et al. | 4/541.6 |
| 4,985,943 | 1/1991 | Tobias et al. | 4/541.6 |
| 5,095,558 | 3/1992 | Howard | 4/541.6 |
| 5,269,029 | 12/1993 | Spears et al. | 4/541.6 |

OTHER PUBLICATIONS

*1992 Product Specification Catalogue,* Hydro Air, Inc., Orange CA.

*Primary Examiner*—Charles E. Phillips

[57] ABSTRACT

A combination adjustable jet valve for use in a spa, tub or the like, having a valve body and nozzle assembly which can be easily manipulated to adjust the water jet flow, aeration of the water jet and direction of the discharging water jet. A flush mounted control grip on the spa valve body can be rotated to vary the water jet from off to full flow positions. The valve nozzle can be pulled to an on position, allowing the valves venturi effect to draw air into the water flow and aerate the discharging water jet. Alternatively, the nozzle can be pushed into the off position such that air is no longer drawn into the water flow and the discharging water jet is no longer aerated. The nozzle is mounted into a ball socket type arrangement within the valve, allowing directional adjustment of the discharging water jet. Also disclosed is an embodiment where both the water and air are controlled through manipulation of the spa valve nozzle.

15 Claims, 3 Drawing Sheets

COMBINATION ADJUSTABLE JET VALVE

BACKGROUND OF THE INVENTION

1. Field of the Invention

This invention relates to jet valves and more particularly to fluid flow controlling jet valves used in spas or tubs.

2. Description of the Related Art

Spa valves have been utilized extensively in spas, tubs, baths and the like to provide a water jet or aerated water jet of variable flow which can be directed against a persons body to provide therapeutic massage action. A conventional spa includes a tub portion which holds the water. The tub will typically have a plurality of small holes in the sides and sometimes in the base for the mounting of jet valves. A water pump is used to draw water from the tub and discharge it back into the tub through the jet valves in the form of a water jet. It is common practice to provide an air line to the spa valves for aeration of the exhausting water jet. Air is typically drawn into the water jet through the venturi effect of the flowing water, but sometimes, air is supplied under pressure from an air pump. Control of the air for this aeration is provided by manipulation of an aeration valve. The aeration valve may also be a distribution valve which allows selection of which jet valves will provide air. Aeration valves are typically located at the air inlet manifold separate from the jet valves. Once the aeration valve is opened to a water jet, aeration of the water jet can be further varied by adjusting the water flow at each jet valve. Water flow to each jet valve has been controlled at a central distribution valve, but more commonly at each individual jet valve itself.

Service of the jet valve and the aerator is typically a two step repair, with service of the aeration valve being made at the air intake manifold and service of the jet valve being made at the water distribution valve or at the jet valve itself.

Thus, a need exists for a jet valve that can fully adjust both water flow and aeration at the spa valve itself. A need also exists for a jet valve that can control water flow and aeration and that is easily and fully serviceable from a single location within the spa. A further need exists for a fully controllable jet valve that can be easily retrofitted into the extensive number of currently owned spas and tubs.

SUMMARY OF THE INVENTION

The present invention comprises spa jet valve that fits a standard spa valve housing having an air inlet and a water inlet. The valve comprises both an adjustable valve body and nozzle assembly which can be easily manipulated to adjust the water jet flow, aeration of the water jet and the direction of the discharge. A flush mounted control grip on the spa jet valve body can be rotated to vary the water jet from off to full flow positions. The valve nozzle can be pulled to an on position, allowing the valves venturi effect to draw air into the water flow and aerate the discharging water jet. Alternatively, the nozzle can be pushed into the off position such that air is no longer drawn into the water flow and the discharging water jet is no longer aerated. The nozzle is mounted into a ball socket type arrangement within the valve, allowing directional adjustment of the discharging water jet. Also disclosed is an embodiment where both the water and air are controlled through manipulation of the spa valve nozzle.

Various additional features are included in the present invention. One such feature is the flat profile of the water flow controlling grip and the recessed nozzle. This allows the spa valve to be non intrusive into the spa or tub. The second preferred embodiment of the present invention lacks an external adjustment flange and is completely recessed within the spa or tub wall. A second feature is a oneway valve in the air inlet line. This check-valve prevents water from running into the air line and blocking the free flow of air for aeration of the water jet. Another feature is the loose tolerances of the valve itself. The valve is manufactured with relatively loose tolerances to allow for some leakage across the water ports to prevent the potential for burn out of the water pump motor should a number of spa valves become blocked. The loose tolerances also allow for lower manufacturing costs and a less expensive spa valve.

In the preferred embodiment, the spa valve is equipped with upper and lower valve bodies. The upper valve body has an external adjustment flange with a flat profile that is rotated to control the flow of water through the lower valve body of the spa valve. When the adjustment flange is rotated in one direction, water flow is shut off. As the adjustment flange is rotated in the opposite direction, the flow increases to the full flow position.

In another embodiment of the present invention, the spa jet valve has only one valve body and lacks an external adjustment flange. The valve nozzle is rotated to control the flow of water through the valve. This provides single point control of the water flow and aeration and is a simpler design. In both embodiments, the nozzle is slid into the valve body to stop aeration of the water jet and is pulled out to activate aeration.

One significant advantage of the spa jet valve of the present invention is the ability to adjust both the flow of water and the aeration of the water jet at the spa valve without the need or use of separate controls.

A further significant advantage of the spa jet valve of the present invention is the ability to service both the water and air controlling portions of the valve from a single point within the spa and without need to access the valve housing. The spa jet valve of the present invention can be completely removed from the valve housing from inside of the spa or tub and serviced or replaced.

Another advantage of the spa jet valve of the present invention is the ability to easily retrofit and upgrade the multitude of existing spas with the spa jet valve of the present invention. Previous jet valves that utilize standard jet valve housings can simply be removed and the spa jet valve of the present invention installed in its place. Water jet flow and aeration can now be controlled at the new spa jet valve and the separate aeration and water distribution valve can simply be left in the open positions or discarded.

The objects, features, and advantages described in the specification are not all inclusive, and particularly, many additional features and advantages will be apparent to one of ordinary skill in the art in view of the specifications, drawings and claims. The described present invention together with the operation of the invention will be understood by reference to the following detailed description taken together with the drawings.

BRIEF DESCRIPTION OF THE DRAWINGS

Two preferred forms of the present invention are illustrated in the accompanying drawings in which.

DETAILED DESCRIPTION OF THE PREFERRED EMBODIMENTS

Figure 2:
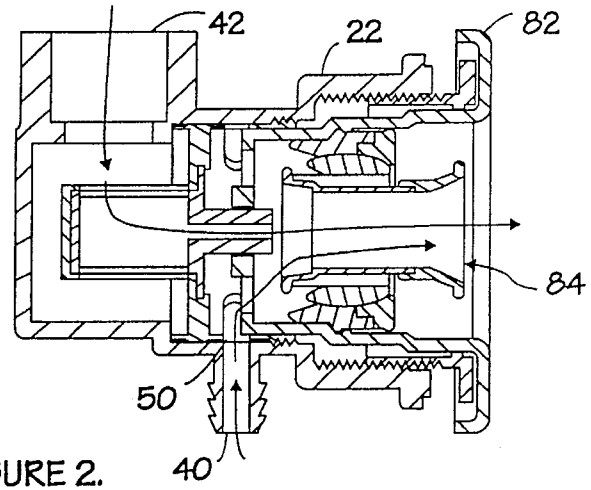
FIG. 2 is a cross-sectional view of the present spa jet valve in a first preferred embodiment showing the valve position when the water and air passages are in the full open positions.

Referring to the drawings and more particularly to FIGS. 1 through 5, a first preferred embodiment of the present water and air adjustable spa jet valve 20 (FIG. 1) includes a valve housing 22 having a open front chamber 24 (FIG. 3), a first internal chamber 26, and a second internal chamber 28. The open front chamber 24 has a threaded interior wall, while the first internal chamber 26 has a partially threaded internal wall. The chambers 24, 26 and 28 are all cylindrical.

The open front chamber 24 of the valve body or housing 22 leads directly into the first internal chamber 26 which leads into the second internal chamber 28. The 10 external end of the open front chamber 24 is formed into a flange 32 which butts up against the spa or tub wall (not shown). The valve housing 22 is fixed to the wall of the spa or tub by a flanged sleeve 34 which passes through a water jet hole in the side of the spa or tub (not shown). The flanged sleeve 34 has external threads which mate with the internal threads in the open front chamber 24 allowing compression of the spa or tub wall between the valve housing flange 32 and the flanged sleeve 34. Tabs 38 (FIG. 4) or slots (not shown) located on the exterior face of the flanged sleeve 34 are provided to facilitate tightening or removing the valve housing 22.

Figure 3:
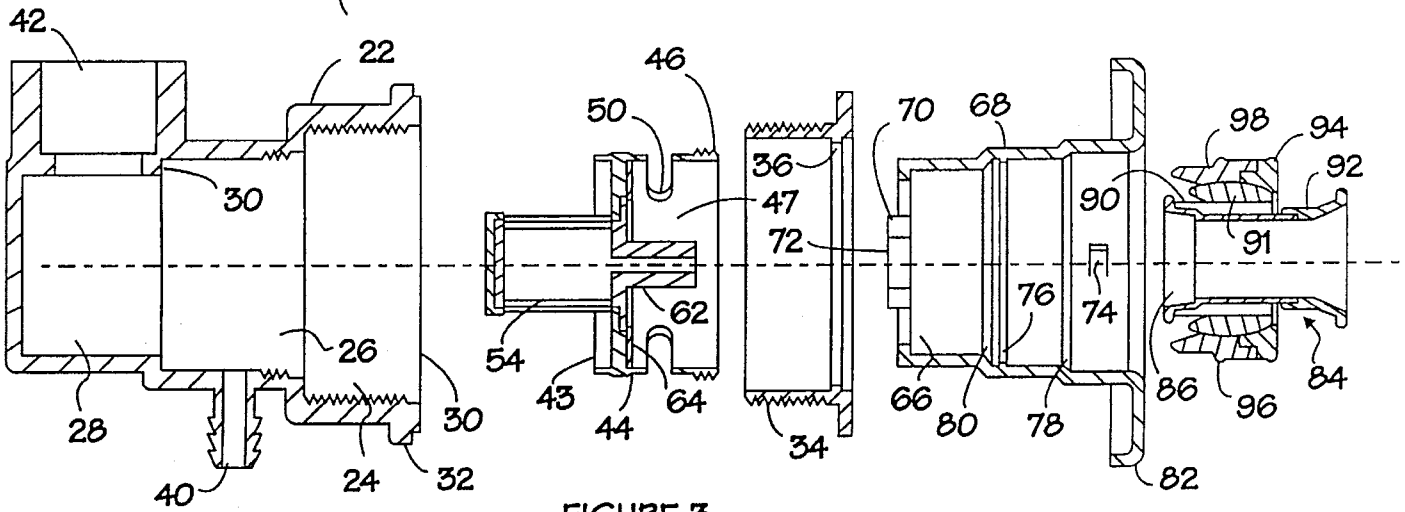
FIG. 3 is a cross-sectional assembly view of the present spa jet valve in its first preferred embodiment.

With reference to FIG. 3, the valve housing 22 is formed with an air inlet 40 and a water inlet 42. The air inlet 40 is connected to an ambient air supply line (not shown) and the water inlet 42 is connected to the pressurized water supply (not shown). Pressurized water is fed into the second internal chamber 28 through the water inlet 42. Ambient air is fed into the first internal chamber 26 through the air inlet 40.

An inner valve body 44 having an externally threaded rim 46 is fitted within the first internal chamber and second internal chamber 26 and 28. The base of the inner valve body 44 seats against the internal step 30 within the valve housing 22 and is retained in the valve housing 22 by mating the externally threaded rim 46 with the internal threads of the first internal chamber 26. The base 43 of the inner valve body 44 further seats against the internal step 30 of the valve housing 22 to prevent the free flow of water into the aeration chamber 66. A plurality of water inlet slots 48 (FIG. 4) direct the flow of water from the second internal chamber 28 through the center of the inner valve body 44 and into the aeration chamber 66. A plurality of air inlet slots 50 allow free flow of air from the first internal chamber 26 to the aeration chamber 66.

Figures 4, 5:
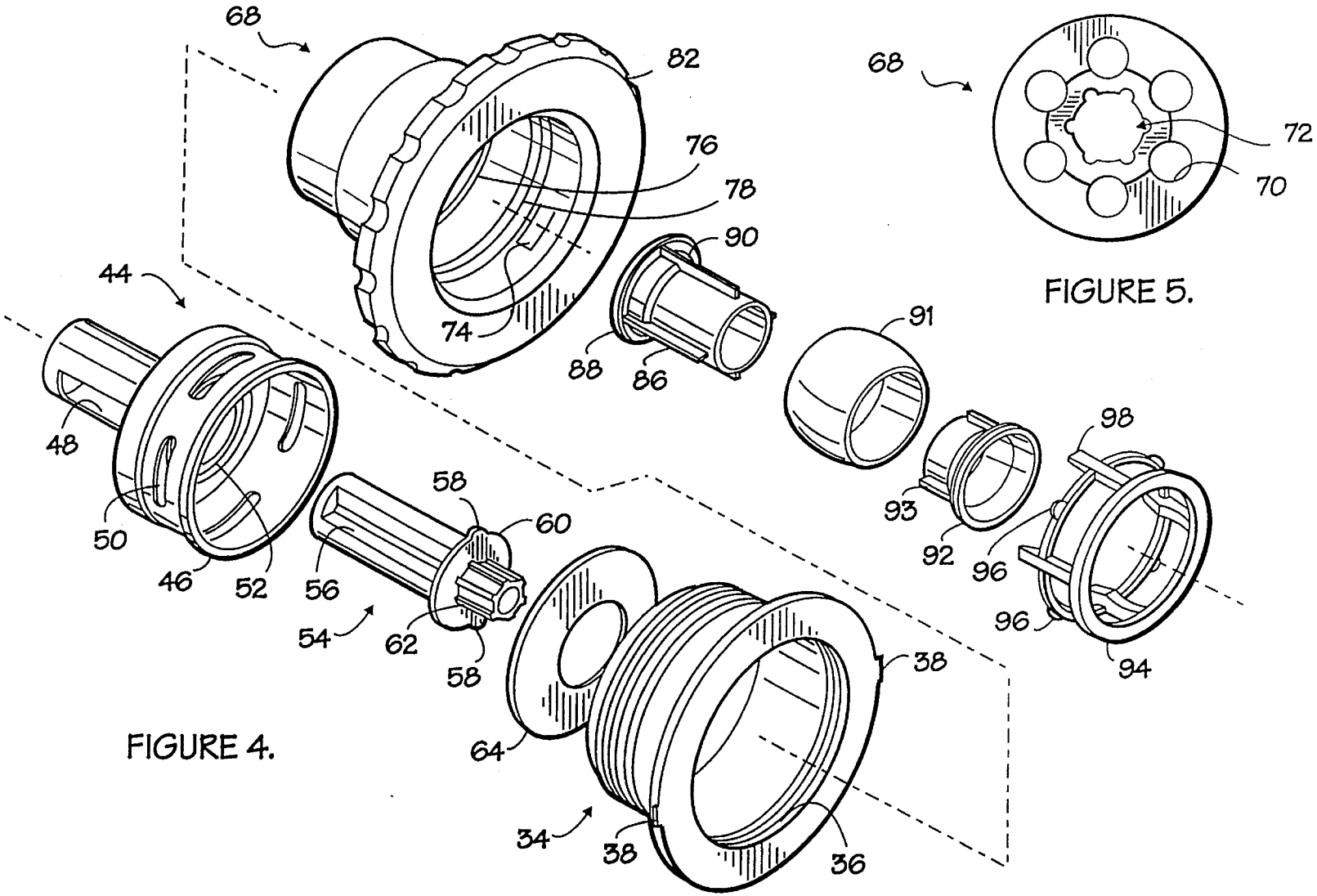
FIG. 4 is an exploded perspective view of the present spa jet valve in its first preferred embodiment.
FIG. 5 is a rear view of the base of the upper valve body of the present spa jet valve in its preferred embodiment.

A valve sleeve 54 fits inside the inner valve body 44 and is restrained to only rotate within the inner valve body 44 by a retaining disc 64 which is secured to the inner valve body 44 through a compression fit or an adhesive. With reference to FIG. 4, the valve sleeve 54 is further restrained by tabs 58 located on the valve sleeve flange 60 and matching recessed slots 52 in the inner valve body 44 such that it can only rotate through a 90 degree arc. The valve sleeve 54 has a plurality of water passage slots 56 which can be aligned with the water inlet slots 48 of the inner valve body 44 in one position, allowing free flow of water, and completely closed off when the valve sleeve 54 is rotated 90 degree. When the water passage slots 56 of the valve sleeve 54 are aligned with the water inlet slots 48 of the inner valve body 44, water is directed through the inner valve body 44 and valve sleeve 54 and out through the hollow center of the shaped outlet shaft 62 and into the aeration chamber 66 (FIG. 3). The flow of water into the aeration chamber 66 and thus into the discharging water jet can be controlled to vary from full flow to no flow by simply rotating the shaped outlet shaft 62 and thus the valve sleeve through its 90 degree travel. The valve sleeve 54 is fit tightly enough inside the inner valve body 44 to prevent appreciable water leakage when the water inlet slots 48 and water passage slots 56 are not aligned and the water passage is closed off, but loose enough that it can be freely rotated through the said 90 degree travel.

An outer valve body assembly 68 (FIG. 3) fits inside the open front chamber 24 and first internal chamber 26 of the valve housing 22. The outer valve body assembly 68 seats inside the cupped upper section 47 of the inner valve body 44 and is restrained from coming out of the valve housing 22 by a plurality of locking tabs 74 that prevent the outer valve body assembly 68 from sliding over the retaining lip 36 on the flange sleeve 34. The outer valve body assembly 68 can easily be removed for service or repair by lifting the locking tabs 74 over the retaining lip 36 while exerting a slight pulling force on the control grip 82.

The shaped outlet shaft 62 freely fits into a matching shaped shaft receiver 72 (FIG. 5) located on the base of the outer valve body assembly 68 and forces the valve sleeve 54 to rotate when the outer valve body assembly 68 is rotated. Thus, user rotation of the control grip 82 from 0 to 90 degrees adjusts the alignment of the water slots 48 and 56 and controls the water flow from zero to full flow.

Figure 1:
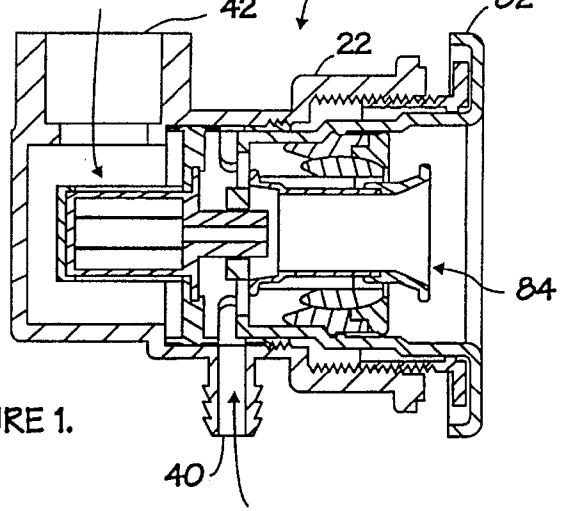
FIG. 1 is a cross-sectional view of the present spa jet valve in a first preferred embodiment showing the valve position when the water and air passages are in the closed positions.

With reference to FIG. 3, a plurality of air inlet holes 70 located on the base of the outer valve body 68 allow air to freely pass into the valve body assembly 68 and the aeration chamber 66. Referring specifically to FIGS. 1, 2 and 3, the passage of air will be described. When drawn by the flowing water jet's venturi, ambient air enters the valve housing 22 through the air inlet 40. The air is free to flow through the air inlet slots 50 of the inner valve body 44 and through the air inlet holes 70 of the outer valve body assembly 68 into the aeration chamber 66.

Referring FIGS. 3 and 4, a nozzle assembly 84, composed of an inlet section 86 connected together with an outlet section 92, is free to slide inside the tubular hollow shaft of the ball 91. A socket 94 with socket legs 98 form a hollow spherical interior which holds the ball 91, acting as a ball-joint. Changing the nozzle 84 direction is accomplished as the ball 91 moves within the socket 94. Thus, the direction of the water jet can be controlled by a user reaching inside the open front chamber 24 and moving the outlet section 92 of the nozzle assembly 84 to point in the direction of the desired water jet flow.

The socket 94 seats inside the outer valve body assembly 68 on a formed step 80. A plurality of tabs 96, located on the exterior of the socket 94 fit behind the raised retaining lip 76 inside the outer valve body assembly 68 to hold the socket 94 and associated ball 91 and nozzle assembly 84 into the outer valve body 68. The top of the socket 94 seats against a first step 78 in the outer valve body assembly 68. The increased diameter of the outer valve body 68 before the first step 78 facilitates user access to the exposed nozzle outlet section 92.

The nozzle assembly 84 is free to move within the tubular hollow shaft of the ball 91 by sliding on fins 90 mounted on the outside of the nozzle inlet section 86. The flared section 88 of the nozzle inlet section 86 prevents the nozzle assembly 84 from pulling out of the ball 91. The flared section 88 also provides for improved aeration of the water jet. Stops 93 are mounted on the exterior of the nozzle outlet section 92 and restrain the nozzle assembly 84 from being pushed too far into the ball 91. The nozzle outlet section 92 is flared to provide better water jet action and ease of user handling.

Referring specifically to FIGS. 2 and 3, when the nozzle assembly 84 is pulled out, to its on position, a space is created in the aeration chamber 66 between the top of the shaped outlet shaft 62 and the flared inlet section 86 of the nozzle assembly 84. This space is sufficient such that the venturi from the flowing water jet can draw air into and aerate the water jet. Reducing the flow of water through the nozzle assembly 84 by rotating the control grip 82 reduces the venturi and draws less air into the water jet. By adjusting the flow of water through the nozzle assembly 84, a user can readily adjust the water flow and aeration level to his desired comfort level.

Referring now to FIGS. 1 and 3, when the nozzle assembly 84 is pushed into its closed (off) position, the space in the aeration chamber 66 between the top of the shaped outlet shaft 62 and the nozzle inlet section 86 is greatly reduced or eliminated. The venturi from the flowing water jet can no longer draw in air and the discharging water jet is solely water.

Figure 7:
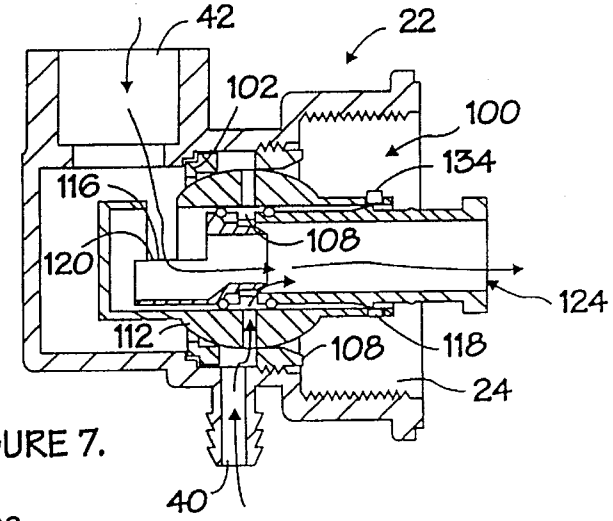
FIG. 7 is a cross sectional view of the present spa jet valve in a second preferred embodiment showing the nozzle position when the water and air passages are both in the full open positions.
Figure 6:
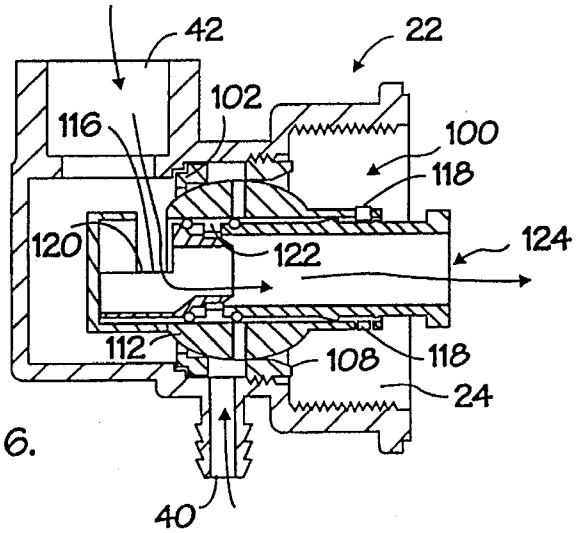
FIG. 6 is a cross sectional view of the present spa jet valve in a second preferred embodiment showing the nozzle position when the water passage is in the full open position and the air passage is in the closed position.
Figure 8:
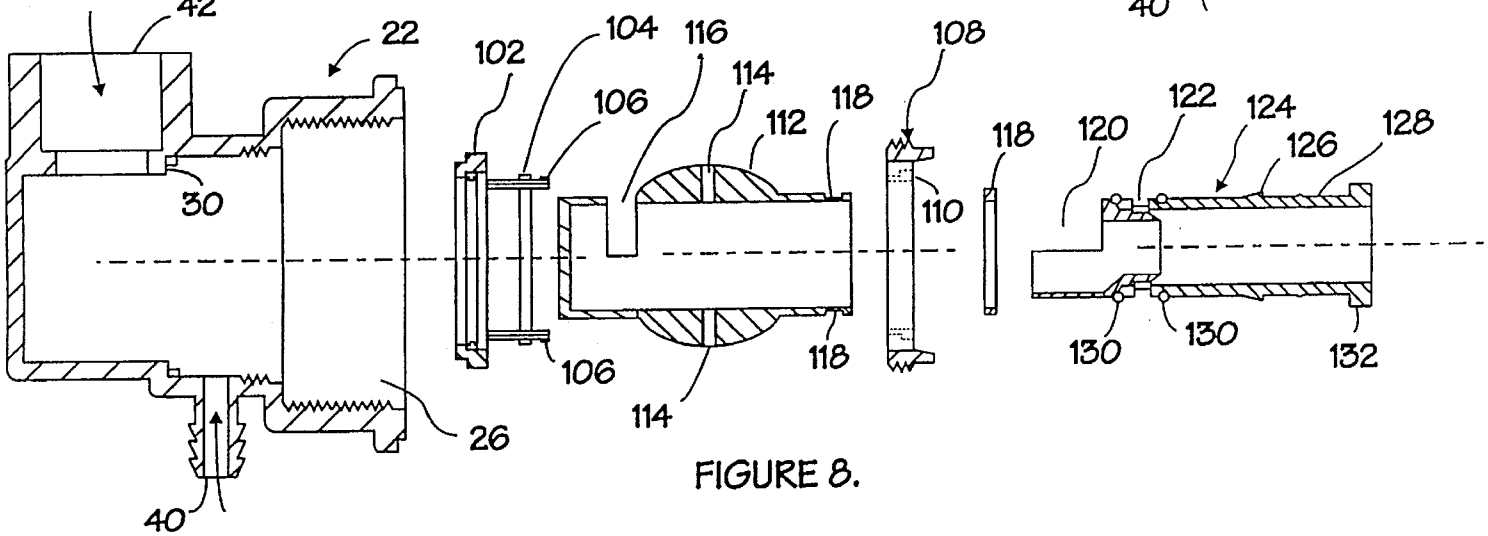
FIG. 8 is a cross sectional assembly view of the present spa jet valve in its second preferred embodiment.

Referring now to FIGS. 6, 7 and 8, the second preferred embodiment of the present invention will be described. An alternate spa jet valve 100, utilizing the same valve housing 22 as the spa jet valve of the preferred embodiment, has a hollow valve body 112 with a water inlet slot 116, a plurality of air inlet slots 114 located in the spherically shaped central region and a plurality holes 118 for a C-clamp ring or equivalent. The valve body 112 is retained in the valve housing 22 by a socket basket 102 which has a hollow spherically shaped interior. The spherically shaped exterior portion of the valve body 112 fits inside the socket basket 102. The base of the socket basket 102 seats into the internal step 30 of the valve housing 22. An externally threaded socket cap 108 with locking tab slots 110 fits over the matched locking tabs 106 of the socket basket 102 and holds the valve body 112 in place, acting as a ball-joint. A support ring 104 on the socket basket 102 fixes the locking tabs 106 and adds strength to the assembly. The external threads on the socket cap 108 mate with the internal threads inside the first internal chamber 26 of the valve housing 22 to secure the socket basket 102 and associated valve body 112 to the valve housing 22. A user, by reaching into the open front chamber 24 of the valve housing 22 and articulating the nozzle assembly 124, can direct the water jet to a desired position.

The nozzle assembly 124 fits inside and is free to slide and rotate within the valve body 112. A C-clamp ring 134 which clamps into the plurality of stop holes 118 in the valve body 112, restrains the otherwise free sliding of the nozzle assembly 124 between two raised stop rings 126 and 128 on the exterior of the nozzle assembly 124.. The ramped stop ring 126 is provided to facilitate assembly and repair of the spa jet valve 100. The nozzle assembly 124 has a plurality of air inlet slots 122 and a water inlet slot 120.

When the nozzle assembly 124 is pulled into the out (on) position, the air inlet slots 114 in the valve body 112 are aligned with the air inlet slots 122 in the nozzle assembly 124, and air is drawn into the water jet by the venturi effect of the flowing water. When the nozzle assembly 124 is pushed into the valve body 112, the air inlet slots 122 of the nozzle assembly 124 are sufficiently blocked against the interior wall of the valve body 112 by one of the O-rings 130 that air cannot be pulled into the water jet and only water is discharged through the nozzle assembly 124. Smooth sliding and sealing of the nozzle assembly 124 against the interior wall of the valve body 112 is accomplished through a plurality of o-rings 130 fitted on the exterior of the nozzle assembly 124.

A user can adjust the flow of water through the spa jet valve 100 by rotation of the nozzle assembly 124. Rotating the nozzle assembly 124 until the water inlet slot 120 of the nozzle assembly 124 is aligned with the water inlet slot 116 in the valve body 112 allows full flow of water through the nozzle 124. By rotating the nozzle assembly 124 180 degrees to the closed position, such that the water inlet slot 120 in the nozzle assembly 124 is blocked by the exterior wall of the valve body 112, water flow through the nozzle is stopped. Adjustability of water flow through the valve body 112 from zero to full flow is accomplished by rotating the nozzle assembly 124 between 0 and 180 degrees.

While the preferred embodiments of the present invention have been described above, it will be recognized and understood that various changes and modifications may be made therein and the appended claims are intended to cover all such modifications which may fall within the spirit and scope of this invention.

What is claimed is:

1. A spa jet valve capable of utilizing a standard spa jet housing for discharging an adjustable mixture of air and water into a spa, said spa jet valve comprising: a cylindrical hollow valve body having a cylindrical shape and a central axis, an aeration chamber positioned in said valve body, said valve body having a water inlet port and a separate air inlet port for directing water and air through said valve body and into said aeration chamber, means mounted in said valve body to manually control and adjust the flow of water into said aeration chamber; and a tubular rotatable nozzle mounted within said valve body and extending into the spa interior, said nozzle communicating with said aeration chamber for discharging a set of water and air from said aeration chamber into the spa, said nozzle including means of manually controlling the flow of air in to said aeration chamber independent of said means to control and adjust the flow of water, said nozzle further including means of directional adjustment for controlling the direction of the set discharging into the spa.

2. The spa jet valve of claim 1, wherein said means to adjust the flow of air into said aeration chamber comprises a means of sliding said nozzle within said hollow valve body parallel to said central axis such that air is drawn into said aeration chamber in one said nozzle position and no air being drawn in another said nozzle position.

3. The spa jet valve of claim 2, wherein said means to adjust the direction of said nozzle within said valve body comprises: a hollow ball mounted to the exterior walls of said nozzle and a socket whose interior matches the shape of said ball, said socket retaining said ball tightly enough such that an exterior force is required for movement of said nozzle but loosely enough so that it can adjusted by simple finger manipulation, said socket being fixed to said valve body.

4. The spa jet valve of claim 3, wherein said means to adjust the flow of water into to said aeration chamber comprises a inner valve body with separate water and air inlet ports mounted within said hollow valve body, said inner valve body including water inlet ports aligned with said water inlet ports of said hollow valve body in one position and closed in another position.

5. The spa jet valve of claim 4, wherein a control grip is connected to said inner valve body such that rotation of said control grip acts to rotate said inner valve body and adjust the flow of water into said aeration chamber.

6. The spa jet valve of claim 3 wherein said means to adjust the flow of water into said aeration chamber comprises an inlet port situated towards the rear of said nozzle, said water inlet port being aligned with said hollow valve body water inlet port when rotated in one position and said water inlet port being proportionately closed off to said hollow valve body water inlet port as said nozzle is rotated.

7. The spa jet valve of claim 6 wherein said nozzle has a plurality of air inlet ports allowing air to enter said aeration chamber from said valve body.

8. A spa jet valve for creating and discharging an adjustable mixture and flow of air and water comprising:

a valve housing having an internally threaded open front chamber, two additional internal chambers, an air inlet port and a water inlet port;

an externally threaded flanged sleeve for clamping said spa jet valve to a spa or tub wall, said threaded flange sleeve being threaded into said valve housing's internally threaded open front chamber;

an inner valve body having a cylindrical through bore, side walls and plurality of separate openings through the side walls into the valve body for passage of both water and air from the valve housing air and water inlet ports into the inner valve body;

a valve sleeve having a cylindrical through bore and a plurality of inlet slots for passage of water into the cylindrical through bore, said sleeve fitting inside and freely rotating within a limited range within said inner valve body;

an outer valve body rotatable within said valve housing and fixed such it can rotate said valve sleeve and control the amount of water flowing into the outer valve body from the valve housing, said outer valve body including a control grip located in the spa or tub for user actuation and an aeration chamber in which air is drawn into the flow of discharging water;

a nozzle that is slidable and directable from the valve housing open front chamber to open or close air flow into said aeration chamber and to direct the discharging flow, said nozzle intake located at the aeration chamber and nozzle outlet located within the spa or tub.

9. The spa jet valve of claim 8 wherein the control grip for rotating said outer valve body is part of said outer valve body and extends into and is flush mounted to the wall of the spa.

10. The spa jet valve of claim 9 wherein the valve sleeve is constrained within the inner valve body to rotate sufficiently to align and close off the mating water inlet slots of the inner valve body and the valve sleeve, said rotation being approximately 90 degrees.

11. The spa jet valve of claim 10 wherein tabs fixed to the said outer valve body retain it inside the valve housing by latching over a raised ring located inside the threaded sleeved flange.

12. The spa jet valve of claim 11 wherein the means to retain and direct the said nozzle is accomplished with a hollow ball and socket assembly, said hollow ball mounted to the outside of said nozzle and said socket fixed inside said outer valve body.

13. The spa jet valve of claim 12 wherein a plurality of tabs located on the exterior of the socket latch over a raised lip inside the outer valve body and act to fix said socket and associated said nozzle assembly inside the said outer valve body.

14. The spa jet valve of claim 13 wherein the nozzle is sufficiently small that persons fingers can easily be used to manipulate said nozzle within said open front chamber of said valve housing and control the flow of water and air and the direction of the discharging flow.

15. The spa jet valve of claim 14 wherein the valve housing is compatible and interchangeable with standard spa jet housings.

* * * * *